United States Patent [19]

Bowes

[11] 4,071,988

[45] Feb. 7, 1978

[54] CORE AND BEAM SUSPENSION SYSTEM FOR A BUILDING CONSTRUCTION AND METHOD OF CONSTRUCTION

[76] Inventor: Peter Bowes, 1700 Civic Center Drive, No. 601, Santa Clara, Calif. 95051

[21] Appl. No.: 456,004

[22] Filed: Mar. 29, 1974

[51] Int. Cl.[2] ..... E04B 1/34; E04B 1/35

[52] U.S. Cl. ..... 52/127; 52/73; 52/126; 52/236.3; 52/745

[58] Field of Search ..... 52/167, 127, 236, 745, 52/73, 126

[56] References Cited

U.S. PATENT DOCUMENTS

| | | | |
|---|---|---|---|
| 1,205,465 | 11/1916 | Maguire et al. | 52/236 |
| 2,715,013 | 8/1955 | Slick | 52/745 X |
| 3,053,015 | 9/1962 | Graham | 52/745 |
| 3,179,374 | 4/1965 | Walli | 52/745 X |
| 3,254,466 | 6/1966 | Heidenstam | 52/745 |
| 3,260,028 | 7/1966 | Fraser | 52/745 |
| 3,292,313 | 12/1966 | Entwistle | 52/236 X |
| 3,349,527 | 10/1967 | Bruns | 52/236 X |
| 3,396,502 | 8/1968 | Contevita | 52/745 X |
| 3,594,965 | 7/1971 | Salther | 52/126 X |
| 3,638,377 | 2/1972 | Caspe | 52/167 |
| 3,822,522 | 7/1974 | Termohlen et al. | 52/745 |
| 3,856,242 | 12/1974 | Cook | 52/167 |

FOREIGN PATENT DOCUMENTS

| | | | |
|---|---|---|---|
| 626,263 | 8/1961 | Canada | 52/745 |
| 82,3 97 | 1/1953 | Denmark | 52/745 |

*Primary Examiner*—Leslie Braun

*Attorney, Agent, or Firm*—Owen, Wickersham & Erickson

[57] ABSTRACT

A multi-floor building of the kind in which floors are suspended from a central support has a support core with a plurality of vertically spaced and horizontally aligned openings for individual floor support beams. The building floors are built at ground level and lifted to the desired height on the support core. Floor support beams are inserted through horizontally aligned openings in the support core between the floor. The floor is then set on the support beams to support the floor at that level directly from the core and independently of all the other floors of the building.

The system uses jack rod support beams on top of the support core. Jack rods are connected down from the jack rod support beams, and lifting jacks jack up the jack rods to lift each floor to the desired level.

A conveyor beam lifts each support beam to a position in which the support beam can be inserted through the openings. A removable winch carried on the floor pulls the support beam through the openings in the side walls.

4 Claims, 11 Drawing Figures

CORE AND BEAM SUSPENSION SYSTEM FOR A BUILDING CONSTRUCTION AND METHOD OF CONSTRUCTION

BACKGROUND OF THE INVENTION

This invention relates to methods and apparatus for constructing a multi-floor building of the kind in which the floors are suspended from a central support.

One example of a building construction of this kind is shown in U.S. Pat. No. 3,396,502 issued Aug. 13, 1968 to J. Contevita. In this prior art system all the floors are suspended from two central towers by straps suspended from saddles placed on top of the towers. The floors are then connected to the straps by pins at each floor level.

This prior art suspension system has a number of disadvantages. First of all, the entire system is dependent on the position of the saddle for leveling the floors. Any shifting of the saddle causes an amplified shifting or tilting of the floors. Thus, a 2 inch shift of the saddle will cause all of the floors to be off by 4 inches because one strap on one side of the support tower is displaced 2 inches in one direction and the related strap on the other side of the tower is displaced 2 inches in the opposite direction.

The straps are necessarily big and heavy and therefore awkward to handle. Twisting of the straps on the saddle can also be a problem. And, of course, any movement of one strap produces resultant movement of all floors because of the connection of that strap to each of the floors.

SUMMARY OF THE PRESENT INVENTION

It is the primary object of the present invention to overcome problems of prior art building constructions of the kind in which the floors are suspended from a central support.

It is a closely related object of the present invention to suspend each floor directly from the support core and independently of all the other floors.

In accordance with the present invention a multi-floor building is constructed by forming at least one central support core. The core is a slip-formed concrete core, and a plurality of vertically spaced openings for individual floor support beams are formed in the core. Jack rod support beams are placed on top of the support core, and jack rods are connected down from these jack rod support beams. The floors are built at ground level and then lifted to the desired height by jacking the floor up on the jack rods. Floor support beams are then inserted into the related openings in the support core beneath the floor, and the floor is set on the support beams. Additional floors are built up at ground level and raised to the desired heights by the same sequence of steps described above until the building construction is complete. Because each floor is supported directly from the core by the support beams at that floor level, each floor is supported independently of all the other floors in the building.

Building construction suspension structure and techniques as described above and effective to function as described above constitute additional, specific objects of this invention.

Other objects, advantages and features of my invention will become apparent from the following detailed description of one preferred embodiment taken with the accompaying drawings.

BRIEF DESCRIPTION OF THE DRAWINGS

FIG. 2 illustrates how a beam insertion cable is laid in the openings for the support beams as the lower platform of the slip form goes up;

DESCRIPTION OF THE PREFERRED EMBODIMENTS

Figure 1:
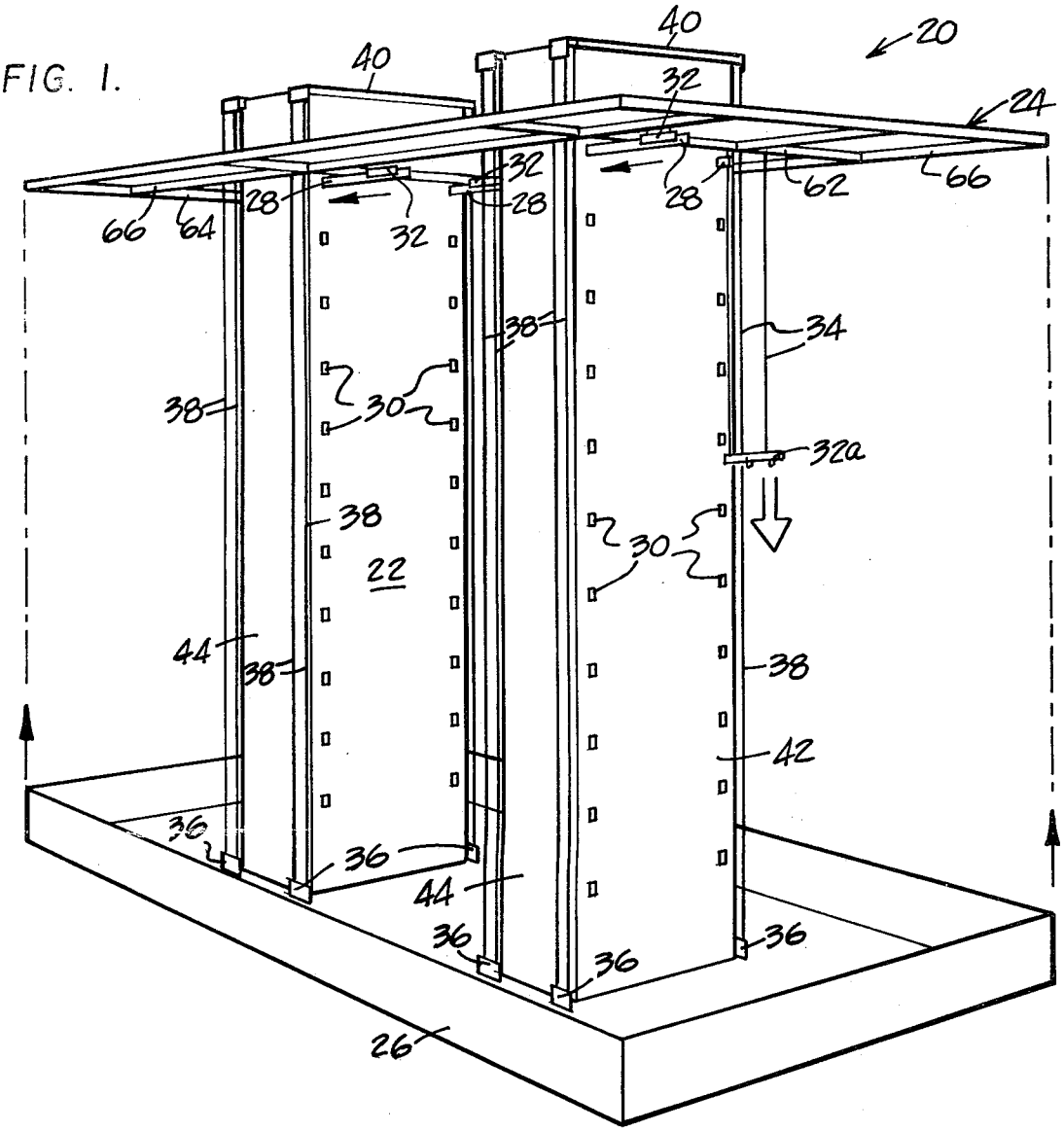
FIG. 1 is an isometric view of a building construction incorporating a suspension system constructed in accordance with one embodiment of the present invention.

A building construction incorporating a suspension system constructed in accordance with one embodiment of the present invention is indicated generally by the reference numeral 20 in FIG. 1.

The building construction 20 incorporates two central support cores 22. All of the floors of the building are suspended from these central supports, and it is a very important feature of the present invention (as will become more apparent from the description to follow) that each floor is supported directly from the cores and independently of all the other floors.

In FIG. 1 a roof 24 is shown in position and in the process of being set on support beams, and with a top floor 26 built at ground level and ready to be raised to an installed position beneath the roof 24.

FIG. 1 shows support beams 28 being inserted in related openings 30 in the side walls of the cores 22 below the roof 24 to support the roof. Each support beam 28 is carried from ground level up to the level for insertion into the core by a conveyor beam 32. One conveyor beam (**32*a* in FIG. 1) is shown being lowered by its cables 34 to ground level after its associated support beam 28** has been inserted into the core.

With continued reference to FIG. 1, the roof 24, top floor 26 and other upper floors are lifted from the ground level build-up to the desired installed height by hydraulic lifting jacks 36. Any suitable hydraulic lifting jack can be used. However, hydraulic jacks made by Heede International, Inc. have been found quite satisfactory.

The jacks 36 lift the floors by climbing jack rods 38. Each lifting jack is connected to the top of the floor by a yoke arrangement (described in more detail below in reference to FIG. 11). The jack rods 38 are connected down from jack rod support beams 40 positioned at the tops of the support cores 22.

Figure 10:
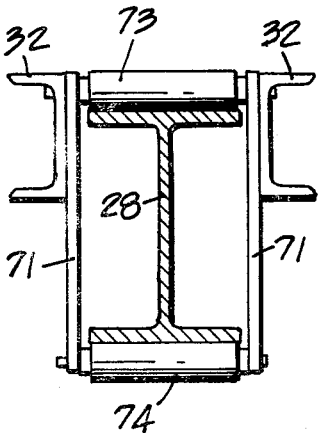
FIG. 10 is an end elevation view taken along the line and in the direction of the arrows 10—10 in FIG. 5 showing details of the roller arrangement on the conveyor beam.
Figure 11:
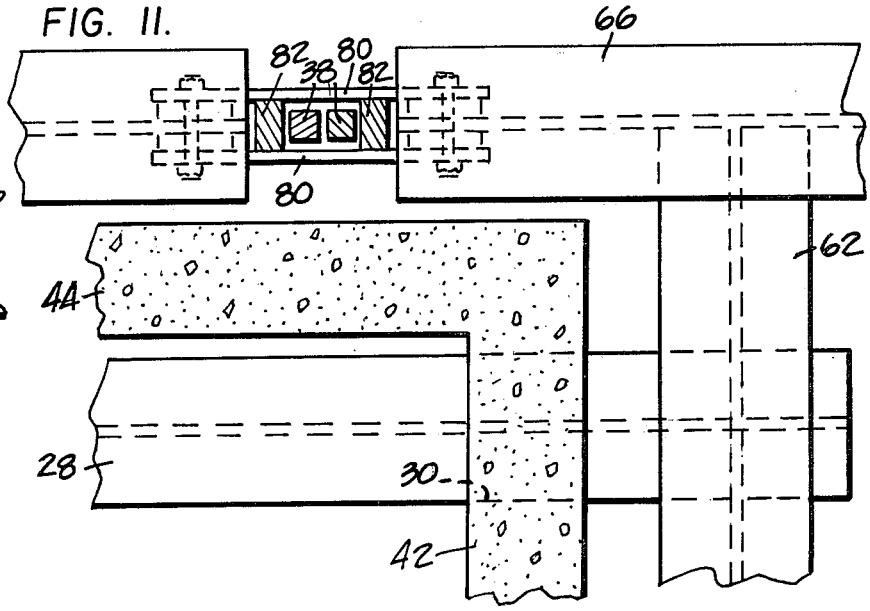
FIG. 11 is a fragmentary plan view taken along the line and in the direction indicated by arrows 11—11 in FIG. 9 at one corner of a support core showing how the floor support beam coacts with other floor beam structures to simplify a yoke arrangement for the jack rods.

As best illustrated in FIGS. 2–11, each support core 22 is a hollow concrete core having two side walls 42 and two end walls 44 (see FIG. 11).

Figure 2:
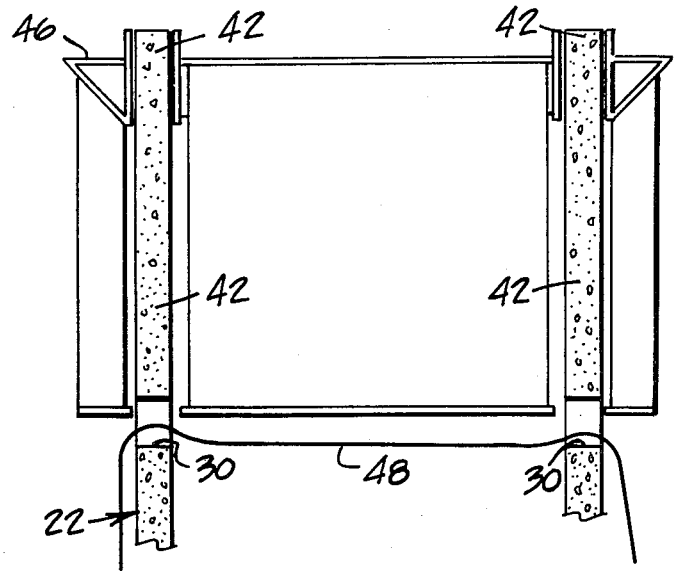
FIG. 2 is a side elevation view in cross section through one of the core supports of the building shown in FIG. 1.

As illustrated in FIG. 2, the core is formed by a slip form 46. It is preferable to take the jack rods support beams 40 up with the slip form 46 as the slip form is moved up in the pouring operation. In this way the jack rod support beams will be in position at the top of the support core when the pouring is completed, and it is then only necessary to connect the jack rods down by screwing together sections from the top down. The jack rod sections are brought up by putting a winch and a set of pulleys on each corner of the jack rod support beams 40.

As also illustrated in FIG. 2, the present invention lays in a beam insertion cable 48 in the support beam openings 30 at each floor level as the support core at that floor level is poured in the slip form 46.

Figure 3:
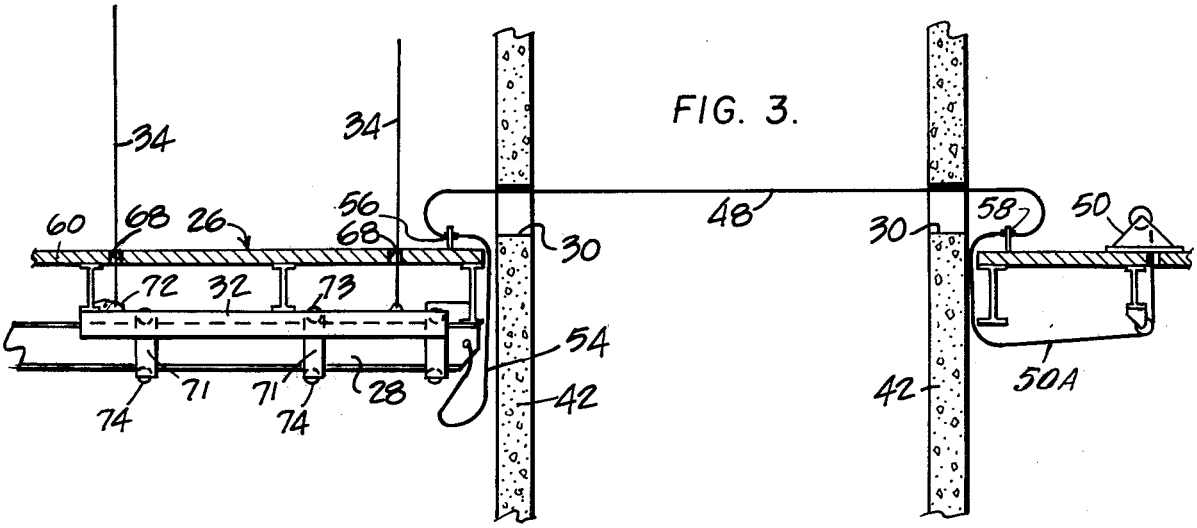
FIG. 3 is a view like FIG. 2 showing how the beam insertion cable is connected to the support beam and to a winch on the floor as the floor is raised to near its installed position.

FIG. 3 illustrates how the ends of the beam insertion cable 48 are connected to the floor support beam 28 and to a floor mounted winch 50 as the floor 26 is raised up to near its desired height. Thus, a cable pigtail 54 is connected to one end of the floor support beam 28 and is clamped by a clamp 56 to one end of the beam insertion cable, and a clamp 58 connects the other end of the beam insertion cable to the cable 50A of the winch 50.

Figure 4:
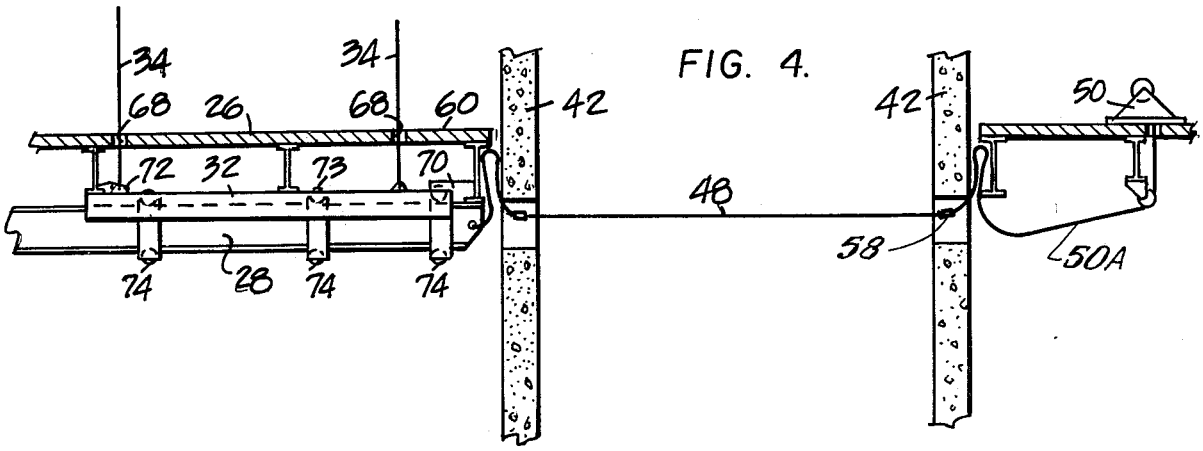
FIG. 4 is a view like FIG. 3 showing details of how ends of the beam insertion cable are passed between the floor and the support core as the floor is raised past the openings for the support beam.

As illustrated in FIG. 4, as the floor 26 is moved up past the openings 30 at floor level, the clamped connections are passed down between the space between the side wall 42 of the core and the adjoining inner edge of the floor 26.

Figure 5:
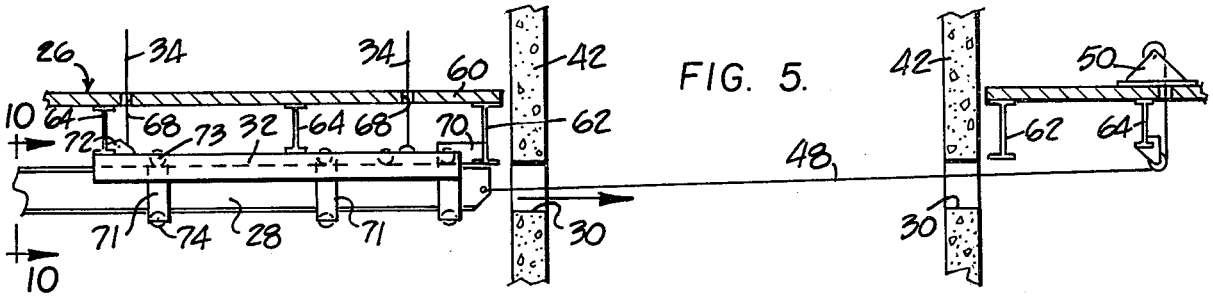
FIG. 5 is a view like FIG. 4 showing the support beam ready to set in place.

The lifting jacks continue to raise the floor 26 until the floor is positioned as shown in FIG. 5.

Each floor is built with a top deck 60 (see FIG. 5) supported by main cross beams 62, additional cross beams 64 and interconnected longitudinal beams 66 (see FIG. 11). This beam arrangement is also shown in FIG. 1 in the underside of the roof 24.

As illustrated in FIGS. 5–9, the cables 34 for the conveyor beams 32 extend down through openings 68 in the floor deck 60. These cables 34 serve to lift and to lower the conveyor beam. They also serve as security cables when the conveyor beam 32 is locked to the cross beams 62 and 64 by locks 70 and 72 during the insertion of the floor support beam 28 into the related openings 30.

Each conveyor beam 32 has a roller assembly for permitting the floor support beam 28 to be pulled out of the roller assembly and into the openings 30 in the core.

As best shown in FIGS. 5 and 10 this roller assembly comprises downwardly extending flanges 71. The flanges 71 are attached to the inner sides of the conveyor beam 32 (as best shown in FIG. 10) and top and bottom rollers 73 and 74 engage the upper and lower flanges of the support beam 28 to permit the support beam 28 to be readily pulled out of the conveyor beam and roller assembly.

Figure 6:
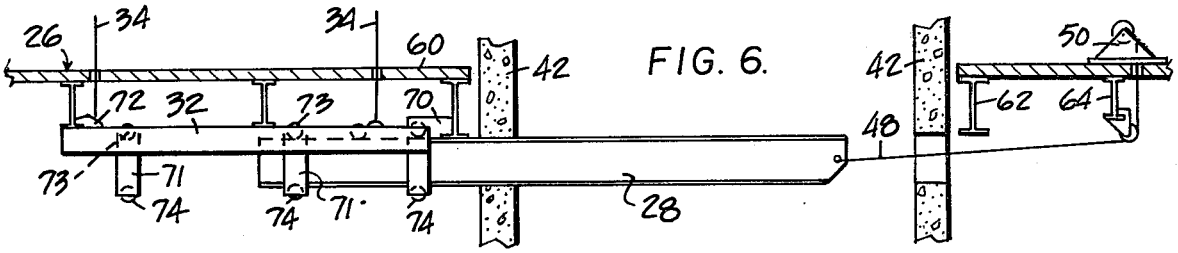
FIG. 6 is a view like FIG. 5 showing the beam being winched into position.
Figure 7:
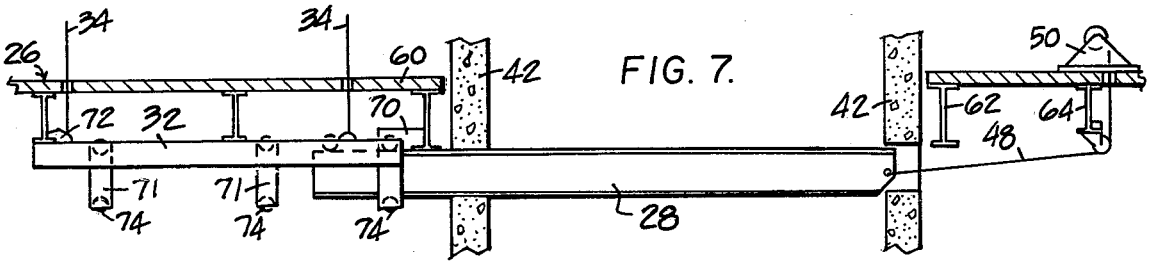
FIG. 7 is a view like FIG. 6 showing the final stages of the support beam set.

Thus, when the floor 26 has been positioned as illustrated in FIG. 5, the support beam 28 is ready to be inserted in the core. The winch 50 pulls the beam insertion cable 48 taut and the beam 28 into the core as illustrated in FIGS. 6 and 7.

Figure 8:
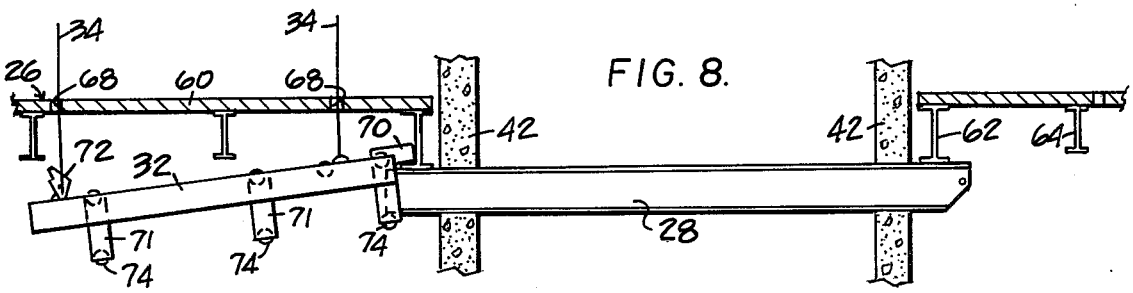
FIG. 8 is a view like FIG. 7 showing the support beam in place and unlatching of the conveyor beam lock.

After the support beam has been winched into place, the conveyor beam locks 70 and 72 are latched as illustrated in FIG. 8. The winch 50 is removed from the floor just installed and is mounted on the next floor being built up at ground level.

Figure 9:
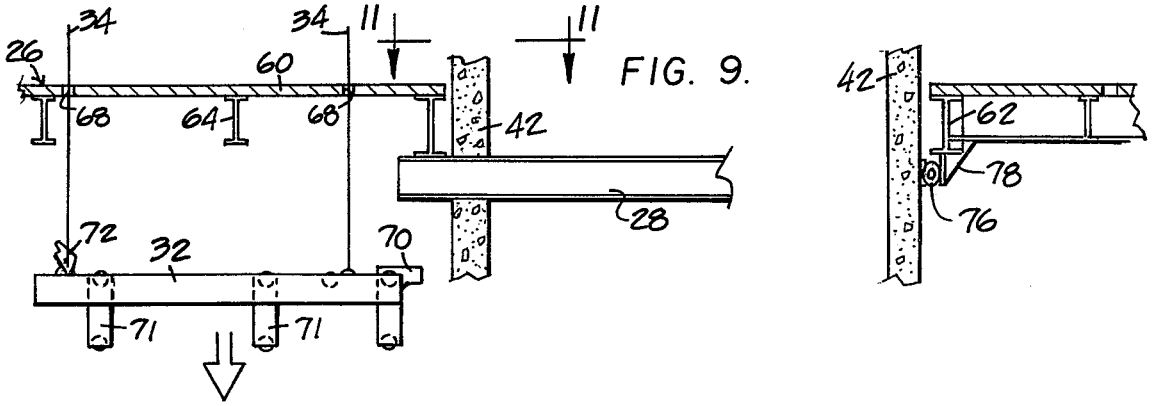
FIG. 9 is a view like FIG. 8 showing the lowering of the conveyor beam to the ground for the next lift.

The conveyor beam is also lowered to ground level for the next lift as illustrated in FIG. 9.

As also illustrated in FIG. 9 a shock mitigation system comprising a seismic damper 76 and an angle 78 welded in with a knee brace is installed between the side wall 42 and a related main cross beam 62.

As pointed out above, the way in which the floor support beam 28 is associated with the floor permits the yoke arrangement for lifting jacks to be simplified.

With reference to FIG. 11, the floor support beam 28 supports the main cross beam 62. The main cross beam 62 in turn supports the longitudinal beam 66 so that the longitudinal beam 66 can be made up of a plurality of beam sections which are spliced together by plates 80. The plates 80 are bolted or otherwise connected to the webs of the beam 66 in the areas of the jack rods 38. Since the flanges of the beam section 66 are not required to carry floor loads in these areas, it is not necessary to form a welded together flange with a cut out for a jack rod 38 or yoke bars 82 for the lifting jack. Instead, the yoke bars 82 need be connected only to the plates 80 as illustrated, and this simplifies the construction of the yoke.

The present invention thus provides a building construction suspension system in which all of the floors of the building are suspended from central supports and provides the important advantage that each floor is supported directly from the support core and independently of all the other floors.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

I claim:

1. A suspension system for a building construction of the kind in which floors are suspended from a central support, said system comprising, at least one core support means formed with a plurality of vertically spaced openings for individual floor support beam means, floor lifting means for lifting each floor from a ground level build-up to the desired height on the core support means, and floor support beam means associated with related openings in the core support means for supporting a floor directly from the core support means and independently of all the other floors after the floor has been lifted to the desired height, and wherein the floor lifting means include at least one jack rod support beam on top of the core support means, a plurality of jack rods connected down from the jack rod support beam and lifting jacks associated with the jack rods and connectable to the top of the floor to be raised, and wherein the core support means include a hollow concrete tower formed by slip forming and having laterally spaced sidewalls with horizontally aligned openings in each sidewall, and wherein the floor support beam means include a plurality of support beams each longer than the width between the tower side walls and including conveyor beam means for lifting each support beam to a position in alignment with a pair of horizontally aligned openings in the sidewalls and operable to permit the support beam to be pulled from the conveyor beam means and inserted through the aligned openings with outwardly projecting ends for supporting the floor above the installed support beam.

2. The invention defined in claim 1 including a beam insertion cable installed in and extending through each pair of horizontally aligned openings as the tower side walls are formed by slip forming, winch means mounted on top of the floor on a side of the tower opposite that of the conveyor beam means, and connector means for connecting the winch means to one end of the beam insertion cable and for connecting the other end of the beam insertion cable to the support beam whereby the support beam can be winched into position through the horizontally aligned openings by the winch means after the floor has been raised to the desired level and the conveyor beam has been lifted to position the support beam in horizontal alignment with the openings in the side walls beneath the floor at the desired level.

3. A method of constructing a multi-floor building of the kind in which floors are suspended from a central support, said method comprising, (a) forming at least one support core with a plurality of vertically spaced openings for individual floor support beams, (b) building an upper floor at ground level, (c) lifting the floor to the desired height on the support core, (d) inserting a floor support beam into an opening in the support core beneath the floor, (e) setting the floor on the support beam to support the floor at that level directly from the core and independently of all the other floors of the building, (f) repeating steps (b) through (e) to add a selected number of additional floors, and including positioning at least one jack rod support beam on top of the support core, connecting jack rods down from the jack rod support beam, lifting the floor to the desired height by jacking the floor up on the jack rods, and including forming the support core of concrete by slip forming and taking the jack rods support beam up the core concurrently with the slip forming, and wherein the concrete core is a hollow core having two laterally spaced sidewalls and wherein the openings in the core are horizontally aligned in the sidewalls at each floor level and including conveying each support beam by a conveyor beam to a level in the line with a pair of horizontally aligned openings in the sidewalls beneath the floor, inserting the support beam from the conveyor beam through the pair of aligned openings, and then lowering the conveyor beam to the ground level for use with the next floor being built up.

4. The invention defined in claim 3 including forming the openings in the concrete side walls concurrently with the slip forming, inserting a beam insertion cable through horizontally lined openings when slip forming, connecting one end of the beam insertion cable to a support beam and connecting the other end of the cable to a winch on the floor, and winching the support beam through the aligned openings.

* * * * *